US011142807B2

(12) United States Patent
Wilden et al.

(10) Patent No.: US 11,142,807 B2
(45) Date of Patent: Oct. 12, 2021

(54) TEMPERATURE CONTROL STATION FOR PARTIALLY THERMALLY TREATING A METAL COMPONENT

(71) Applicant: SCHWARTZ GMBH, Simmerath (DE)

(72) Inventors: Frank Wilden, Simmerath (DE); Jörg Winkel, Nideggen-Schmidt (DE); Andreas Reinartz, Monschau (DE)

(73) Assignee: Schwartz GmbH, Simmerath (DE)

( * ) Notice: Subject to any disclaimer, the term of this patent is extended or adjusted under 35 U.S.C. 154(b) by 159 days.

(21) Appl. No.: 16/348,442

(22) PCT Filed: Nov. 8, 2017

(86) PCT No.: PCT/EP2017/078675
§ 371 (c)(1),
(2) Date: May 8, 2019

(87) PCT Pub. No.: WO2018/087191
PCT Pub. Date: May 17, 2018

(65) Prior Publication Data

US 2020/0232053 A1 Jul. 23, 2020

(30) Foreign Application Priority Data

Nov. 11, 2016 (DE) ..... 10 2016 121 699.2

(51) Int. Cl.
*C21D 9/00* (2006.01)
*C21D 1/18* (2006.01)
(Continued)

(52) U.S. Cl.
CPC ..... *C21D 9/0062* (2013.01); *C21D 1/18* (2013.01); *C21D 1/34* (2013.01); *C21D 1/673* (2013.01);
(Continued)

(58) Field of Classification Search
CPC . C21D 1/18; C21D 1/34; C21D 1/673; C21D 9/0062; F27B 2009/124; F27D 15/02; F27D 2009/0089
(Continued)

(56) References Cited

U.S. PATENT DOCUMENTS 2,144,320 A * 1/1939 Bailey ..... C03B 27/044 65/349
6,903,296 B2 * 6/2005 Gomez ..... C21D 1/40 148/566
(Continued)

FOREIGN PATENT DOCUMENTS

| | | |
|---|---|---|
| CN | 102301014 A | 12/2011 |
| EP | 2548975 | 1/2013 |
| JP | 2015080786 A | 4/2015 |

OTHER PUBLICATIONS

Chinese Office Action dated May 7, 2020 in CN Application No. 2017800698640.

*Primary Examiner* — Jessee R Roe
*Assistant Examiner* — Michael Aboagye
(74) *Attorney, Agent, or Firm* — Occhiuti & Rohlicek LLP

(57) ABSTRACT

Disclosed is a tempering station for the partial heat treatment of a metal component, the station including a processing plane arranged in the tempering station, at least one nozzle, aligned to the processing plane, for discharging of a fluid flow for the cooling of at least a first sub-area of the component, and at least one nozzle box, arranged above the processing plane. The at least one nozzle box forms at least one nozzle area in which the at least one nozzle is at least partially arrangeable and/or which at least partially delimits a propagation of the fluid flow, with the at least one nozzle box being at least partially formed with a ceramic material. The tempering station permits a sufficiently reliable thermal
(Continued)

delimitation of heat treatment measures partially acting on the component and/or a sufficiently reliable thermal separation of different heat treatment procedures partially acting on the component.

11 Claims, 2 Drawing Sheets

(51) Int. Cl.
*C21D 1/34* (2006.01)
*C21D 1/673* (2006.01)
*F27D 9/00* (2006.01)

(52) U.S. Cl.
CPC .. *C21D 2221/01* (2013.01); *F27D 2009/0089* (2013.01)

(58) Field of Classification Search
USPC ..... 266/259, 46, 114; 148/547, 545, 548, 148/574, 559, 527, 644
See application file for complete search history.

(56) References Cited

U.S. PATENT DOCUMENTS

| | | | | |
|---|---|---|---|---|
| 8,858,735 | B2 * | 10/2014 | Kondo | C23C 2/06 148/320 |
| 9,168,578 | B2 * | 10/2015 | Yoon | B21D 22/022 |
| 9,951,395 | B2 * | 4/2018 | Shimotsu | C22C 38/00 |
| 2004/0060623 | A1 | 4/2004 | Boke et al. | |
| 2011/0303328 | A1 | 12/2011 | Kondo et al. | |
| 2015/0299817 | A1 | 9/2015 | Shimotsu et al. | |

* cited by examiner

TEMPERATURE CONTROL STATION FOR PARTIALLY THERMALLY TREATING A METAL COMPONENT

CROSS-REFERENCE TO RELATED APPLICATIONS

This application is a National Phase under 35 U.S.C. 371 of International Application No. PCT/EP2017/078675 filed on Nov. 8, 2017, which claims priority to German Application No. 10 2016 121 699.2 filed Nov. 11, 2016, the contents of which are hereby incorporated by reference in their entirety.

FIELD OF THE INVENTION

The invention relates to a tempering station for the partial heat treatment of a metal component and an apparatus for the heat treatment of a metal component. The invention finds particular application in the partial hardening of optionally precoated components made of a high-strength manganese-boron steel.

BACKGROUND

For the manufacture of safety-related vehicle body parts made of sheet steel, it is regularly necessary to harden the steel sheet during or after the forming of the body component. For this purpose, a heat treatment process has been established, which is referred to as "press-hardening". In this case, the steel sheet, which is provided regularly in the form of a board, is first heated in a furnace, and then cooled and cured in a press during the forming process.

For some years now there has been a desire to produce, by means of press hardening, body components of motor vehicles, such as A- and B-pillars, side impact protection supports in doors, sills, frame parts, bumpers, cross members for floors and roofs, and front and rear side components, which have different strengths in sub-areas, so that the body component can partially fulfill different functions. For example, the central area of a B-pillar of a vehicle should have high strength to protect the occupants in the event of a side impact. At the same time, the upper and/or lower end area of the B-pillar should have a comparatively low strength in order to absorb deformation energy during a side impact and/or, for example, to enable softer areas for easy connectability to other body components during the assembly of the B-pillar.

To form such a partially hardened body component, it is necessary for the hardened component to have different material structures or strength properties in the sub-areas. For setting different material structures or strength properties after hardening, the steel sheet to be hardened can, for example, be manufactured with different, interconnected sheet metal areas or be partially differently cooled in the press.

Alternatively, or additionally, it is possible to subject the steel sheet to be hardened to partially different heat treatment processes before cooling and forming it in the press. In this context, for example, only those sub-areas of the steel sheet to be hardened can be heated, in which a structural transformation towards harder structures, such as martensite can take place. It is also possible to carry out the partial heat treatment by means of contact plates, which are designed for partial tempering of the steel sheet by heat conduction. However, this requires a certain amount of contact time with the plates, which is usually longer than a (minimum) cycle time reachable by the downstream press. However, such process management still regularly has the disadvantage that the diffusion of a coating usually applied to protect against scaling on the surface of the steel sheet, such as an aluminum-silicon coating, cannot be efficiently integrated into the heat treatment process. In addition, the coordination between specific contact time and cycle time on the press regularly complicates the integration of corresponding tempering stations in a press-hardening line on an industrial scale, and production fluctuations during operation are usually unavoidable.

If the steel sheet to be hardened is to be partially subjected to different heat treatment processes prior to cooling and forming, there is also the regular problem that the different heat treatment measures that are partially applied to the steel sheet cannot be thermally separated from one another with sufficient reliability. This problem arises in particular when the partially different heat treatment is to be carried out almost simultaneously on the steel sheet.

On this basis, it is an object of the present invention, to at least partially solve the problems described with reference to the prior art. In particular, a tempering station and a device for the heat treatment of a metal component should be provided, which allow for a sufficiently reliable thermal boundary of heat treatment measures partially acting on the component and/or a sufficiently reliable thermal separation of heat treatment measures partially acting on the component.

SUMMARY

These objects are achieved by the features of the independent claims. Further advantageous embodiments of the solution proposed here are specified in the dependent claims. It should be noted that the features listed individually in the dependent claims can be combined with each other in any technologically meaningful manner and define further embodiments of the invention. In addition, the features specified in the claims are described and explained in more detail in the description, wherein further preferred embodiments of the invention are shown.

According to the invention, a tempering station is proposed for the partial heat treatment of a metal component, with a processing plane arranged in the tempering station in which the component can be arranged, at least one nozzle which is aligned towards the processing plane and is provided and arranged for discharging a fluid flow for the cooling of at least a first sub-area of the component and at least one nozzle box, which is arranged above the processing plane, wherein the at least one nozzle box forms at least one nozzle area in which the at least one nozzle is at least partially arrangeable and/or at least partially limits the propagation of the fluid flow, wherein the at least one nozzle box is at least partially formed with a ceramic material.

The metal component is preferably a metal board, a steel sheet, or an at least partially preformed semi-finished product. The metal component is preferably formed with or from a (hardenable) steel, for example a boron (manganese) steel, e.g. with the reference 22MnB5. More preferably, the metal component is at least for the most part provided with a (metal) coating or is precoated. The metal coating may be, for example, a (predominantly) zinc-containing coating or a (predominantly) aluminum and/or silicon-containing coating, in particular a so-called aluminum/silicon (Al/Si) coating.

The tempering station is preferably arranged downstream of a first furnace and/or upstream of a second furnace. In the tempering station a processing plane is arranged, in which the component is arrangeable or is arranged. In this case, the processing plane designates in particular the plane into which the component can be moved for treatment in the tempering station and/or in which the component is arranged and/or fixable in the tempering station during the treatment. Preferably, the processing plane is aligned substantially horizontally. Preferably, the component is arrangeable or is arranged in the processing plane and is alignable or is aligned relative to the nozzle box. Preferably, the component is aligned relative to the nozzle box when it is arranged in the processing station.

The tempering station has at least one nozzle. The nozzle is aligned towards the processing plane. In addition, the nozzle is provided and arranged for discharging a fluid flow for the cooling of at least a first sub-area of the component, in particular so that a temperature difference between the at least one first sub-area (ductile in the finished treated component) and at least a second sub-area (in the finished treated component relatively harder part) of the component is adjustable. Preferably, a plurality of nozzles is provided, wherein the nozzles are particularly preferably arranged as a nozzle field. If a plurality of nozzles is provided, the nozzle box may form a separate nozzle area for each nozzle and/or a common nozzle area for several or all of the nozzles from the plurality of nozzles. Preferably, the (each) nozzle is shaped in the manner of a flat radiant nozzle and/or a round nozzle.

Furthermore, the tempering station has at least one nozzle box, which is arranged above the processing plane. The nozzle box may be designed in the manner of a frame, a box and/or housing in which recesses and/or spaces may be provided, in which nozzles and/or heat sources can be accommodated. In particular, the nozzle box is formed, in particular shaped, such that it can at least partially (thermally) separate, delimit and/or shield at least one nozzle area from the environment and/or from at least one heating area. Preferably, the nozzle box has a (horizontal) width which is in particular at least one and a half times greater than the (vertical) height of the nozzle box. Preferably, the nozzle box, in particular at a lower end or on the underside an (outer) contour, which is formed substantially corresponding to or analogous to an outer contour of a component (to be treated).

The at least one nozzle box forms at least one nozzle area. Preferably, a plurality of nozzle areas may be formed. The at least one nozzle area is preferably formed or shaped by the nozzle box such that it can at least partially accommodate at least one nozzle. To form the nozzle area, the nozzle box can have one or more walls and/or wall areas which at least partially surround the nozzle area and/or limit or delimit from the environment and/or from at least one heating area. Preferably, the nozzle box has at least one (inner) wall which completely surrounds a nozzle area, viewed in a cross-section oriented parallel to the processing plane.

In the at least one nozzle area, the at least one nozzle is at least partially arrangeable or arranged. Preferably, the at least one nozzle projects at least partially into the nozzle area or is even arranged completely in the nozzle area. Alternatively or additionally, the nozzle area is formed such that the nozzle area at least partially limits the propagation of the fluid flow. This advantageously makes it possible for a fluid flow discharged to the component by means of the at least one nozzle to be guided in a targeted manner to the at least one first sub-area of the component, in particular even if the nozzle does not protrude into the nozzle area or is arranged therein. Preferably, the nozzle area or a nozzle wall (inner) wall of the nozzle box which forms the nozzle area limits a propagation of the fluid flow in a lateral and/or horizontal direction.

In addition, the at least one nozzle box is at least partially formed with or made of a ceramic material. Preferably, at least one wall and/or at least one wall area of the nozzle box is formed with or from the ceramic material, which particularly preferably separates at least one nozzle area from at least one heating area (thermal and/or spatial). Preferably, the ceramic material is sintered.

According to a further aspect, a tempering station for the partial heat treatment of a metal component is proposed, with a processing plane arranged in the tempering station, on which the component is arranged, and at least one nozzle, which is aligned with the processing plane for discharging a fluid flow for the at least partly cooling of the component is provided and arranged, at least one heat source, which is provided and adapted to provide thermal energy to at least a second part of the component and at least one nozzle box, which is arranged above the processing plane, wherein the at least one nozzle box forms at least one nozzle area, in which the at least one nozzle is at least partially arrangeable and/or at least partially limits a propagation of the fluid flow, wherein the at least one nozzle box has at least one nozzle separate from the at least one nozzle area and forms an area in which the heat source is at least partially arranged and/or at least partially limits the propagation of heat energy.

The at least one heat source is preferably at least one radiant heat source. The heat source is preferably an actively operable, in particular electrically operable or energizable heat source. Particularly preferably, the heat source is formed with an electrically operated heating element (not physically or electrically contacting the component). The heating element may be a heating loop and/or a heating wire. Alternatively or additionally, the heat source may be formed with a (gas-heated) radiant tube.

The at least one heating area is formed by the nozzle box. The at least one heating area is preferably formed or shaped by the nozzle box such that it can at least partially accommodate at least one heat source. To form the heating area, the nozzle box can have one or more walls and/or wall areas which at least partially surround the heating area and/or limit or delimit it from the environment and/or from at least one nozzle area. Preferably, the nozzle box has at least one (inner) wall which completely surrounds a heating area, viewed in a cross-section oriented parallel to the processing plane.

In the at least one heating area, the at least one heat source is at least partially arrangeable or arranged. The at least one heat source preferably projects at least partially into the heating area or is even arranged completely in the heating area. Alternatively or additionally, the heating area is formed such that the heating area at least partially limits the propagation of heat energy. This advantageously makes it possible to specifically guide the at least one heat source to the component discharged or radiated heat energy to the at least one second sub-area of the component, in particular even if the heat source does not protrude into the heating area or is arranged in the same. Preferably, the heating area or a(n inner) wall of the nozzle box forming the heating area limits the propagation of the thermal energy in a lateral and/or horizontal direction. If the heat source is formed by a radiant heat source that can be operated, in particular, electrically or in a gas-heated manner, in particular laterally radiating thermal radiation can be directed or reflected, for example, from an inner wall of the heating area to the second sub-area of the component.

The details, features and advantageous embodiments discussed in connection with the first featured tempering station can also occur accordingly in the presented tempering station, and vice versa. In that regard, reference is made in full to the statements there for a more detailed characterization of the features.

According to an advantageous embodiment, it is proposed that the at least one nozzle box is formed at least partially with or from a fiber-reinforced ceramic material. For example, alumina fibers can be used as fibers. The at least one nozzle box or at least one wall and/or at least one wall area of the nozzle box is preferably formed at least partially with or out of an alumina ceramic reinforced with (fine) alumina fibers.

According to a further advantageous embodiment, it is proposed that the at least one nozzle box is at least partially formed with or from an alumina ceramic. Preferably, at least one wall and/or at least one wall area of the nozzle box is at least partially formed with or from an alumina ceramic. (Almost) all walls and/or wall areas of the nozzle box are particularly preferably formed with or from an alumina ceramic, in particular reinforced with (fine) alumina fibers.

According to an advantageous embodiment, it is proposed that in at least one nozzle area a nozzle field is at least partially arranged with a plurality of nozzles which are apart from one another at a particular distance. Preferably, the shape of the nozzle field and/or the arrangement of the plurality of nozzles is adapted to the geometry (to be achieved) of the at least one first sub-area of the component.

According to an advantageous embodiment, it is proposed that the at least one nozzle area is shaped so that it spans an area of the processing plane in which the at least one first sub-area of the component is arrangeable. Preferably, a cross-section of the nozzle area aligned parallel to the processing plane has a shape or geometry which corresponds to the shape or geometry (to be achieved) of the first sub-area of the component. Further preferably, the at least one heating area is shaped such that it spans an area of the working plane in which the at least one second sub-area of the component can be arranged. Particularly preferably, a cross-section of the heating area oriented parallel to the working plane has a shape or geometry which corresponds to the shape or geometry (to be achieved) of the second sub-area of the component.

In addition, the at least one nozzle area may be arranged at a specific (lateral and/or horizontal) position in or on the nozzle box, which corresponds to a (lateral and/or horizontal) position of the at least one first sub-area in the component, in particular overlaps, as soon as the component is arranged in the processing plane and/or aligned with respect to the nozzle box. In addition, the at least one heating area may be arranged at a specific (lateral and/or horizontal) position in or on the nozzle box, which corresponds to a (lateral and/or horizontal) position of the at least one second sub-area in the component, in particular overlaps, as soon as the component is arranged in the processing plane and/or aligned with respect to the nozzle box.

According to an advantageous embodiment, it is proposed that the at least one nozzle box is at least partially double-walled and/or is at least partially insulated. Preferably, the nozzle box is double-walled in the area of the at least one heating area or at least partially around the at least one heating area and/or is (thermally) insulated. The insulating material is formed in particular with or from a microporous insulating material. Preferably, the insulating material is arranged between the walls and/or wall areas of the nozzle box, to form a double-walled area of the nozzle box. The insulating material is preferably temperature-resistant for temperatures above 1073.15 K.

According to a further aspect, an apparatus for (partial) heat treatment of a metal component is proposed, comprising at least:

one first furnace which can be heated, in particular by means of radiant heat and/or convection, one tempering station downstream of the first furnace.

According to an advantageous embodiment, it is proposed that the apparatus further comprises at least:

one second furnace downstream of the tempering station, in particular heated by means of radiant heat and/or convection heating, and/or one press-hardening tool downstream of the tempering station and/or the second furnace.

According to a further advantageous embodiment, it is proposed that at least the first furnace or the second furnace is a continuous furnace or a chamber furnace. Preferably, the first furnace is a continuous furnace, in particular a roller hearth furnace. The second furnace is particularly preferably a continuous furnace, in particular a roller hearth furnace, or a chamber furnace, in particular a multilayer furnace with at least two chambers arranged one above the other. The second furnace preferably has a furnace interior, in particular (exclusively) which can be heated by means of radiant heat, in which preferably a virtually uniform internal temperature can be set. In particular, when the second furnace is designed as a multi-layer chamber furnace, a plurality of such furnace interior spaces may be present, corresponding to the number of chambers.

Radiant heat sources are preferably (exclusively) arranged in the first furnace and/or in the second furnace. Particularly preferably, at least one electrically operated (component non-contacting) heating element, such as at least one electrically operated heating loop and/or at least one electrically operated heating wire is arranged in a furnace interior of the first furnace and/or in a furnace interior of the second furnace. Alternatively or additionally, at least one in particular gas-heated radiant tube can be arranged in the furnace interior of the first furnace and/or the furnace interior of the second furnace. Preferably, a plurality of radiant tube gas burners or radiant tubes are arranged in the furnace interior of the first furnace and/or the furnace interior of the second furnace, into each of which at least one gas burner burns. In this case, it is particularly advantageous if the inner area of the steel tubes, into which the gas burners burn, is atmospherically separated from the furnace interior, so that no combustion gases or exhaust gases can enter the furnace interior and thus influence the furnace atmosphere. Such an arrangement is also referred to as "indirect gas heating".

The details, features and advantageous embodiments discussed in connection with the tempering stations can accordingly also occur in the apparatus presented here, and vice versa. In that regard, reference is made in full to the statements there for a more detailed characterization of the features.

According to a further aspect, a use of a nozzle box formed at least partially with a ceramic material in a tempering station is proposed, wherein the nozzle box is used for the partial heat treatment of a metal component.

The details, features and advantageous embodiments discussed in connection with the tempering stations and/or the device can accordingly also occur with the use presented here, and vice versa. In that regard, reference is made in full to the statements there for a more detailed characterization of the features.

The invention and the technical environment will be explained in more detail with reference to the figures. It should be noted that the invention should not be limited by the exemplary embodiments shown. In particular, unless explicitly stated otherwise, it is also possible to extract partial aspects of the facts explained in the figures and to combine them with other components and/or findings from other figures and/or the present description. In the Figures:

DETAILED DESCRIPTION

Figure 1:
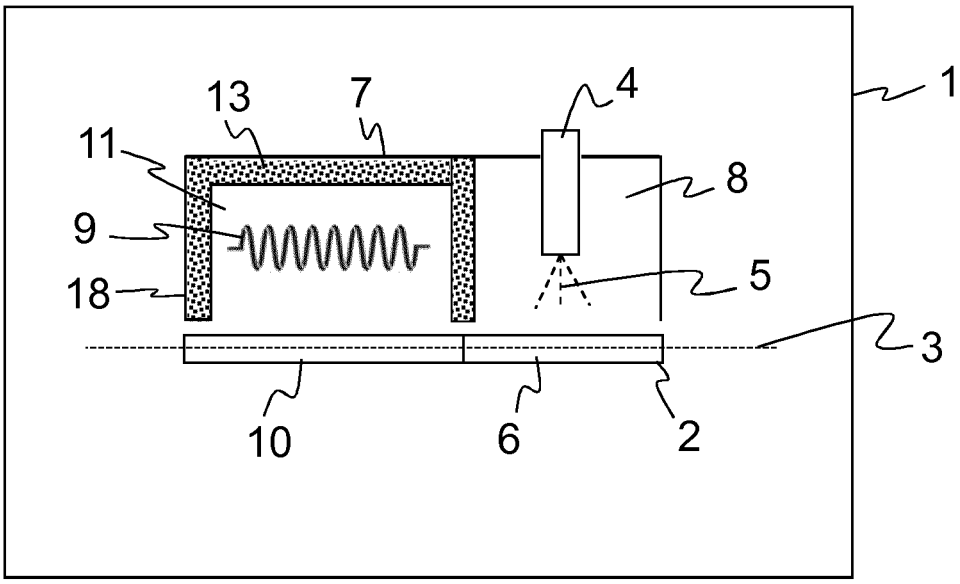
FIG. 1: is a schematic representation of a tempering station according to the invention.

FIG. 1 shows a schematic representation of a tempering station 1 for the partial heat treatment of a metal component 2. In the tempering station 1 a processing level 3 is arranged, in which the component 2 is located. By way of example, the tempering station 1 has a nozzle 4, which is aligned towards the processing plane 3 and provided and arranged for discharging a fluid flow 5 for the cooling of at least a first sub-area 6 of the component 2. In addition, the tempering station 1 has by way of example a heat source 9, which is provided and arranged to provide heat energy to at least a second sub-area 10 of the component 2. The heat source 9 is formed here by way of example in the manner of a resistance heating wire. In addition, the tempering station 1 has a nozzle box 7, which is arranged above the processing plane 3. The nozzle box 7 here forms a nozzle area 8, in which the nozzle 4 is at least partially arranged. In addition, the nozzle box 7, as shown in FIG. 1, forms a heating area 11 separate from the nozzle area 8, in which the heat source 9 is at least partially arranged.

In FIG. 1, the nozzle box 7 with or the walls 18 of the nozzle box 7 are formed of a ceramic material. The ceramic material used here is exemplified by a fiber-reinforced alumina ceramic. In addition, it is shown in FIG. 1 that the nozzle box 7 is double-walled around the heating area 11 and has an insulating material 13 between the walls 18 forming the double-walled area of the nozzle box 7.

According to the illustration according to FIG. 1, it is furthermore shown that the nozzle area 8 is shaped such that it spans an area of the processing plane 3 in which the first sub-area 6 of the component 2 is arranged as soon as the component 2 is arranged in the processing plane 3 and is aligned with respect to the nozzle box 7. In addition, the heating area 11 is shaped such that it spans an area of the working plane 3 in which the second sub-area 10 of the component 2 is arranged. In other words, a cross-section of the nozzle area 8 aligned perpendicularly to the plane of the drawing and parallel to the processing plane 3 has a shape that corresponds to the shape or geometry (to be achieved) of the first sub-area 6. Accordingly, a cross-section of the heating area 11 aligned perpendicularly to the plane of the drawing and parallel to the processing plane 3 has a shape that corresponds to the shape or geometry (to be achieved) of the second sub-area 10.

The nozzle area 8 and the heating area 11 are separated from each other (thermally) by means of the nozzle box, so that the component 2 can be impressed with a temperature profile with differently tempered sub-areas which are as exactly delimited as possible from one another. Due to the fact that a distinct temperature difference between the first sub-area 6 and the second sub-area 10 is set in the first sub-area 6 by the cooling by means of the nozzle 4, after a hardening in a tempering station 1 downstream press-hardening tool (not shown here) in the sub-areas 6, 10 set different material structure and/or strength properties, wherein in the cooled first sub-area 6 a ductile structure and/or a lower hardness can be set than in the second sub-area 10.

Figure 2:
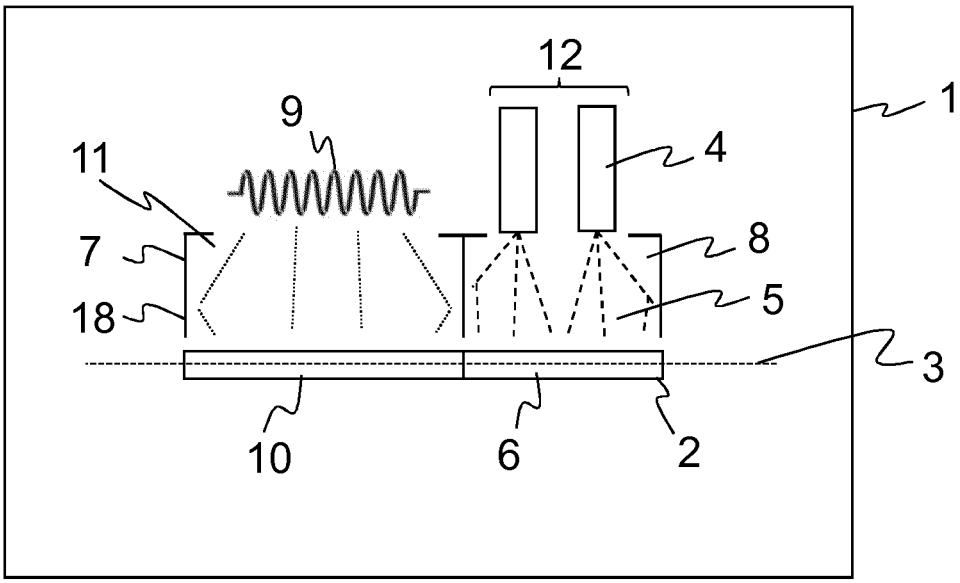
FIG. 2: shows a schematic representation of a further tempering station according to the invention.

FIG. 2 shows a schematic representation of a further tempering station 1 for the partial heat treatment of a metal component 2. Since the reference numerals are used uniformly, only the differences from the tempering station shown in FIG. 1 will be discussed here. In addition, reference is made to the explanations of FIG. 1, which are fully incorporated herein by reference. A first difference is that two nozzles 4 are shown here, which are arranged in the nozzle field 12.

Moreover, FIG. 2 illustrates by way of example that the nozzle area 8 can also be formed such that it limits the propagation of the fluid flow 5 at least partially, for example laterally, without the nozzle(s) themselves having to be arranged in the nozzle area 8. In an analogous manner, the heating area 11 is here exemplarily formed by the nozzle box 7 so that it at least partially limits the propagation of heat energy, for example, laterally. For this purpose, for example, thermal radiation, which is indicated in FIG. 2 by means of dotted lines, can be reflected on the inner walls 18 of the heating area 11.

Figure 3:
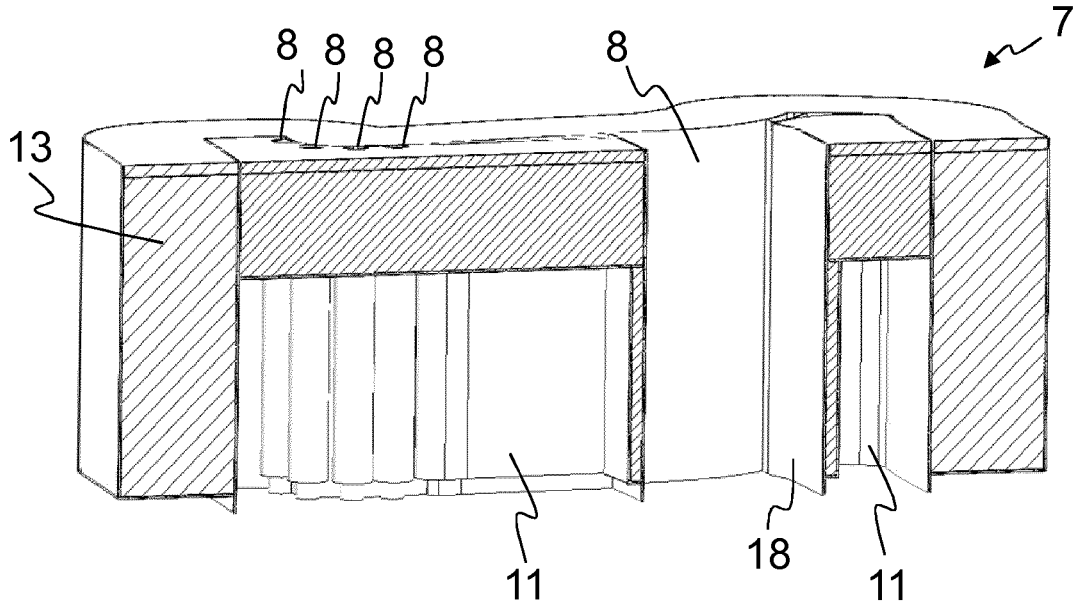
FIG. 3: shows a perspective view of a nozzle box shown in section, which can be used in a tempering station according to the invention.

FIG. 3 shows a perspective view of a nozzle box 7 shown in section, which can in an inventive tempering station (not shown here) are used. The nozzle box 7 here is by way of example a plurality of nozzle areas 8, in which nozzles (not shown here) can be placed and/or it can be blown into the nozzles. In addition, the nozzle box 7 forms a plurality of heating areas 11, in which one or more heat sources (not shown here) are arrangeable. In addition, the nozzle areas 8 are separated from the heating areas 11 by means of the walls 18 of the nozzle box 7 and by means of insulating material 13.

Figure 4:
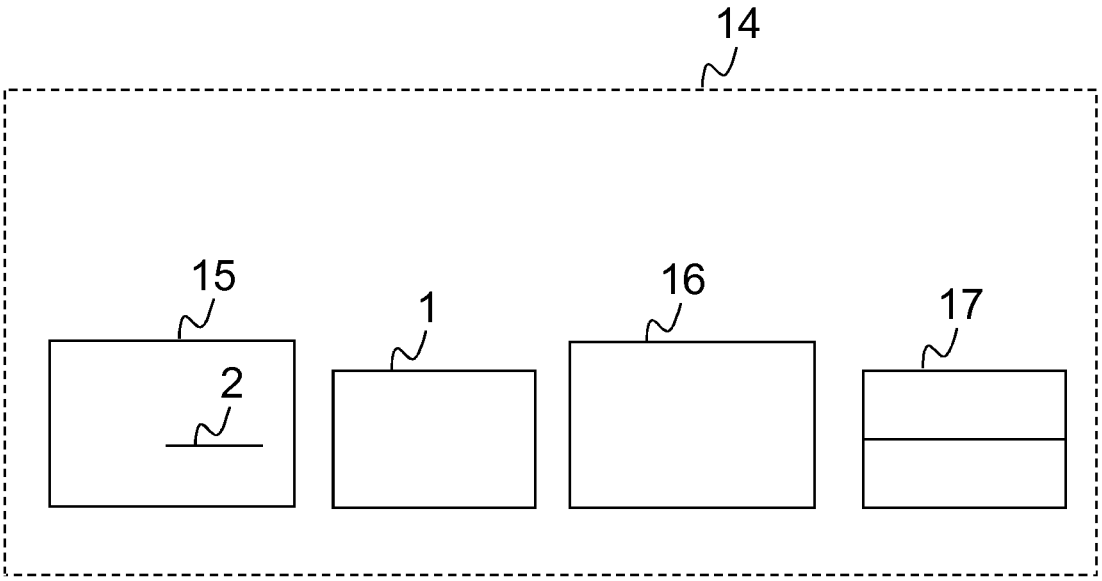
FIG. 4: shows a schematic representation of an apparatus according to the invention.

FIG. 4 shows a schematic representation of an inventive device 14 for heat treating a metal component 2. The apparatus 14 has a heatable first furnace 15, a tempering station 1 (directly) arranged downstream of the first furnace 15, a heatable second furnace 16 (directly) arranged downstream of the tempering station 1, and a press hardening tool 17 (directly) arranged downstream of the second furnace 16. The apparatus 14 here represents a thermoforming line for (partial) press hardening.

A tempering station and a device for the heat treatment of a metal component are disclosed herein, which at least partially resolves problems identified by the prior the art. In particular, the tempering station and the apparatus permit a sufficiently reliable thermal delimitation of heat treatment measures partially acting on the component and/or a sufficiently reliable thermal separation of different heat treatment procedures partially acting on the component.

LIST OF REFERENCE NUMBERS

1 Tempering station
2 Component

3 Processing plane
4 Nozzle
5 Fluid flow
6 First sub-area
7 Nozzle box
8 Nozzle area
9 Heat source
10 Second sub-area
11 Heating area
12 Nozzle box
13 Insulating material
14 Apparatus
15 First furnace
16 Second furnace
17 Press-hardening tool
18 Wall

The invention claimed is:

1. A tempering station for partial heat treatment of a metal component, which defines a first sub-area and a second sub-area, with a processing plane arranged in the tempering station, in which the component is arrangeable, at least one nozzle for cooling the first sub-area of said metal component, which is vertically aligned with the processing plane, and is provided and arranged for discharging a fluid flow for cooling at least a first sub-area of the component, at least one heat source, which is provided and arranged to provide heat energy to at least the second sub-area of the component, and at least one nozzle box, which is arranged above the processing plane, wherein the at least one nozzle box forms at least one nozzle area wherein the at least one nozzle at least partially extends into the nozzle area or is even arranged completely in the nozzle area, and wherein the at least one nozzle box forms at least one heating area separate from the at least one nozzle area, in which at least one heating area the at least one heat source is at least partially arrangeable and/or at least partially limits propagation of heat energy, wherein said nozzle area of said nozzle box is shaped so as to span an area of said processing plane in which said first sub-area of said component has been arranged and to span said area as soon as said component has been arranged in said processing plane and aligned with respect to said nozzle box, wherein said heating area of said nozzle box is shaped such as to span said second sub-area of said component, and wherein the at least one heat source is at least one radiant-heat source.

2. Tempering station according to claim 1, wherein the at least one nozzle box is at least partially formed with a fiber-reinforced ceramic material.

3. Tempering station according to claim 1, wherein the at least one nozzle box is at least partially formed with an alumina ceramic.

4. Tempering station according to claim 1, wherein a nozzle field comprising a plurality of nozzles is at least partially arranged in at least one nozzle area.

5. Tempering station according to claim 1, wherein the at least one nozzle area is shaped so as to span an area of the processing plane in which said first sub-area of said component is arrangeable.

6. Tempering station according to claim 1, wherein the at least one nozzle box comprises thermally-insulating material.

7. Tempering station according to claim 1, wherein at least a portion of the at least one nozzle box is double-walled.

8. An apparatus comprising a tempering station for partial heat treatment of a metal component, which defines a first area and a second area, by heating the metal component while cooling the metal component, the metal component having been arranged on a processing plane within the tempering station, wherein said tempering station comprises a nozzle for cooling said first area of said component, a nozzle box that forms a nozzle area and a heating area, and a radiant-heat source that is arrangeable on a processing plane within the tempering station for heating said second area of said component, wherein said nozzle is arranged in said nozzle area to discharge fluid along a direction that is vertical relative to said processing plane for cooling a first area of said component, wherein said radiant-heat source is arranged within said heating area so as to enable said nozzle box to limit lateral propagation of radiant-heat energy, thereby impressing upon the metal component a temperature profile in which a distinct temperature difference between said first and second areas of said metal component delimits said first and second areas from each other, wherein said nozzle area of said nozzle box is shaped so as to span an area of said processing plane in which said first area of said component has been arranged and to span said area as soon as said component has been arranged in said processing plane and aligned with respect to said nozzle box, and wherein said heating area of said nozzle box is shaped such as to span said second area of said component.

9. The apparatus of claim 8, further comprising a furnace, said furnace being disposed upstream from said tempering station.

10. The apparatus of claim 8, further comprising first and second furnaces, said first furnace being disposed upstream from said tempering station and said second furnace being disposed downstream from said tempering station.

11. The apparatus of claim 8, further comprising a furnace being disposed downstream from said tempering station and press-hardening tool downstream from said furnace.

* * * * *